US011040567B2

(12) United States Patent
Schroeder

(10) Patent No.: US 11,040,567 B2
(45) Date of Patent: Jun. 22, 2021

(54) REUSABLE WRITING SURFACE WITH MAGNETIC LEGS

(71) Applicant: Brian Schroeder, Riverside, CA (US)

(72) Inventor: Brian Schroeder, Riverside, CA (US)

( * ) Notice: Subject to any disclaimer, the term of this patent is extended or adjusted under 35 U.S.C. 154(b) by 60 days.

(21) Appl. No.: 16/442,932

(22) Filed: Jun. 17, 2019

(65) Prior Publication Data

US 2020/0238750 A1 Jul. 30, 2020

Related U.S. Application Data

(60) Provisional application No. 62/796,085, filed on Jan. 24, 2019.

(51) Int. Cl.
*B43L 1/00* (2006.01)
*B43L 3/00* (2006.01)

(52) U.S. Cl.
CPC ..... *B43L 1/008* (2013.01); *B43L 3/008* (2013.01)

(58) Field of Classification Search
None
See application file for complete search history.

(56) References Cited

U.S. PATENT DOCUMENTS

| | | | | |
|---|---|---|---|---|
| 3,623,691 | A * | 11/1971 | Albee, Jr. | A47G 1/24 248/454 |
| 7,712,719 | B2 * | 5/2010 | Derry | F16M 11/38 248/346.06 |
| 7,901,213 | B1 * | 3/2011 | Beno | B43L 1/00 434/412 |
| 9,179,768 | B2 * | 11/2015 | Stubbs | A47B 13/10 |
| 9,483,958 | B1 * | 11/2016 | Feisthemel | G09B 1/08 |
| 9,565,909 | B2 * | 2/2017 | Song | A45C 11/00 |
| 9,795,213 | B1 * | 10/2017 | Vier | F16M 11/2021 |
| 9,851,757 | B2 * | 12/2017 | Tsuchihashi | G06F 1/1671 |
| 10,061,348 | B2 * | 8/2018 | Shen | G06F 1/1626 |
| 2008/0035822 | A1 * | 2/2008 | Chen | F16M 11/242 248/439 |
| 2013/0163197 | A1 * | 6/2013 | Mack | G06F 1/16 361/679.56 |
| 2014/0376179 | A1 * | 12/2014 | Jenkins | G06F 1/1681 361/679.55 |
| 2015/0351537 | A1 * | 12/2015 | Grabowski | A47B 87/002 108/64 |

* cited by examiner

*Primary Examiner* — Sunit Pandya
(74) *Attorney, Agent, or Firm* — Christopher Pilling

(57) ABSTRACT

A reusable writing surface is provided having a board having a front side and a rear side. A plurality of magnets is positioned on the rear side, wherein the plurality of magnets is configured to magnetically attach to a plurality of removable magnetic legs. The plurality of magnets are positioned such that the plurality of removable magnetic legs are configured to stand the reusable writing surface in either a vertical orientation or a horizontal orientation depending on which magnets of the plurality of magnets each magnetic leg attaches.

7 Claims, 4 Drawing Sheets

REUSABLE WRITING SURFACE WITH MAGNETIC LEGS

CROSS-REFERENCE TO RELATED APPLICATIONS

The present invention claims the benefit of Provisional Application U.S. Ser. No. 62/796,085 filed Jan. 24, 2019 entitled "REUSABLE WRITING SURFACE WITH MAGNETIC LEGS", which is hereby disclosed in its entirety at least by reference.

BACKGROUND OF THE INVENTION

1. Field of the Invention

The present invention relates generally to writing surfaces, but more particular to a reusable writing surface with magnetic legs.

2. Description of Related Art

Reusable writing surfaces, such as chalkboards, whiteboards, etc. are well known in the art. However, other than mounting in one location and orientation, or having a dedicated stand, there are limitations for position, portability, and versatility. Consequently, there is a need for a reusable writing surface with magnetic legs

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is a particular object of the present invention to provide a reusable writing surface that overcomes the deficiencies of the prior art. In order to do so, a reusable writing surface is provided, comprising a board having a front side and a rear side; a plurality of magnets positioned on the rear side, wherein the plurality of magnets is configured to magnetically attach to a plurality of removable magnetic legs; and, the plurality of magnets is positioned such that the plurality of removable magnetic legs is configured to stand the reusable writing surface in either a vertical orientation or a horizontal orientation.

In one embodiment, a frame is provided, wherein the plurality of magnets are positioned on the frame. In another embodiment, the plurality of magnets includes a first pair of magnets, a second pair of magnets, a third pair of magnets, and a fourth pair of magnets. In another embodiment, the first pair of magnets is directly opposite the second pair of magnets approximate to a first end of the board. In another embodiment, the third pair of magnets is directly opposite the fourth pair of magnets approximate to a first side of the board. In yet another embodiment, the vertical orientation is comprised of the plurality of removable magnetic legs attached to the first and the second pair of magnets. In another embodiment, the horizontal orientation is comprised of the plurality of removable magnetic legs attached to the third and the fourth pair of magnets. In one embodiment, the board is rectangular shaped. In one embodiment, the plurality of removable magnetic legs is configured to be removed such that the plurality of magnets is configured to magnetically attach to a magnetic surface.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide a reusable writing surface with magnetic legs.

The word "a" is defined to mean "at least one." The terminology includes the words above specifically mentioned, derivatives thereof, and words of similar import.

Figure 1:
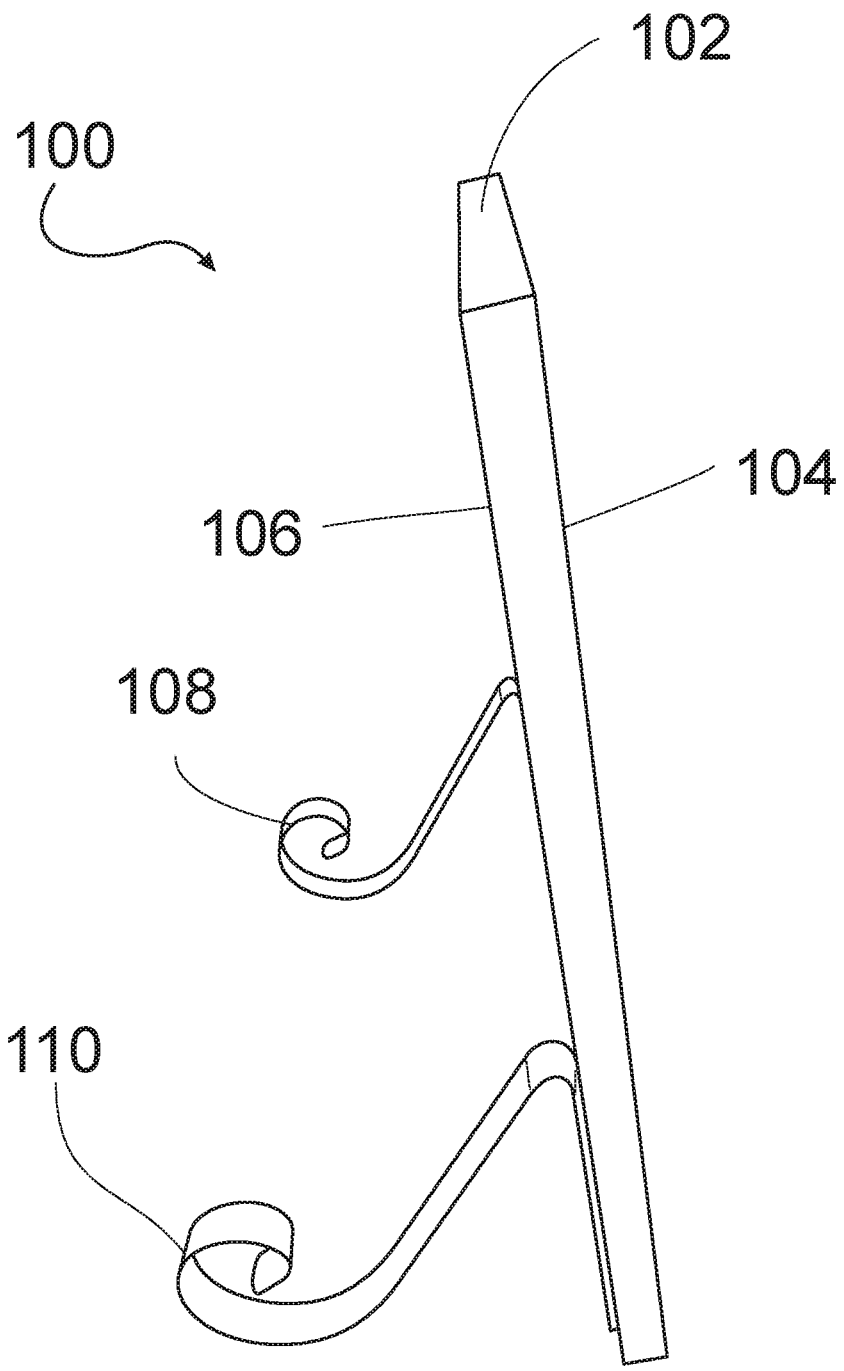
FIG. 1 is a top, side perspective view of a reusable writing surface with magnetic legs according to an embodiment of the present invention.

Referring now to FIG. 1, a reusable writing surface with magnetic legs 100 is illustrated. In one embodiment, the reusable writing surface comprises a board 102, having a front side 104, and a rear side 106. The front side includes a reusable writing surface, as well known in the art. Preferably, this is a chalkboard, however it can be any reusable writing surface known in the art, including but not limited to, a whiteboard, dry-erase board, etc. In one embodiment, the present invention includes magnetic legs 108 and 110. In one embodiment, at least a portion of the magnetic legs contain magnetic material, such as near the attachment location with the board. In another embodiment, the magnetic legs are entirely magnetic. Yet, in another embodiment, the magnetic legs include magnets attached to legs of non-magnetic materials.

Figure 2:
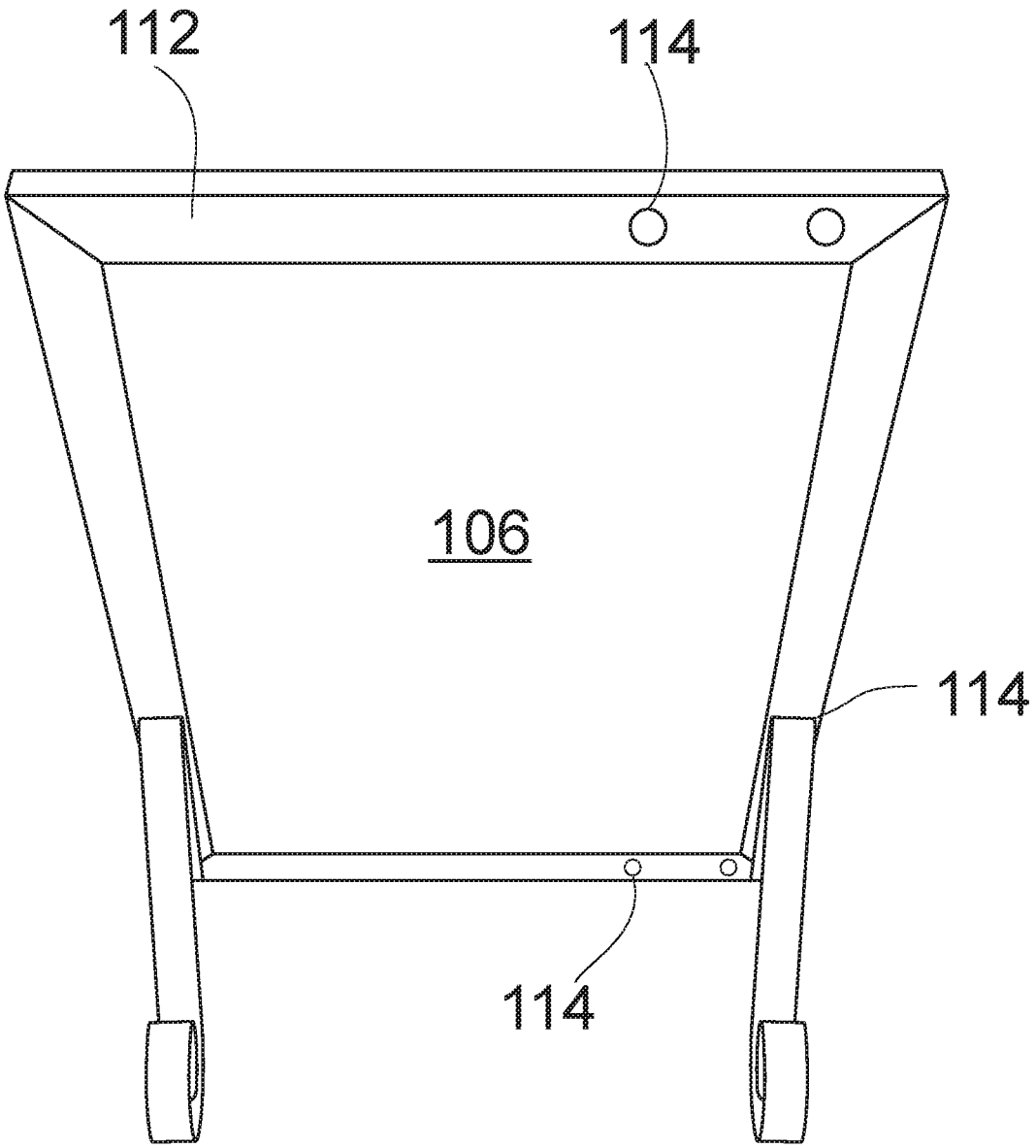
FIG. 2 is a top, rear view of the reusable writing surface with magnetic legs according to an embodiment of the present invention.

Referring now to FIG. 2, rear side 106 of the board is illustrated. Advantageously, frame 112 of board includes a plurality of magnets 114 in specific attachment option locations. The magnets are in magnetic connection with the magnetic legs. Preferably, the magnets are provided on the frame, however, it should be understood, that the magnets may be provided in any location, and not directly on the frame. Yet, in other embodiments, the frame may be constructed from a magnetic material. Further, in some embodiments, keyholes (not illustrated) are provided on the frame enabling the hanging of the board either in a vertical or horizontal orientation on a wall, as well known in the art. It should be understood, that in some embodiments, a frame is not provided, and the magnets and attachment options are directly on the rear side of the board.

Figure 4:
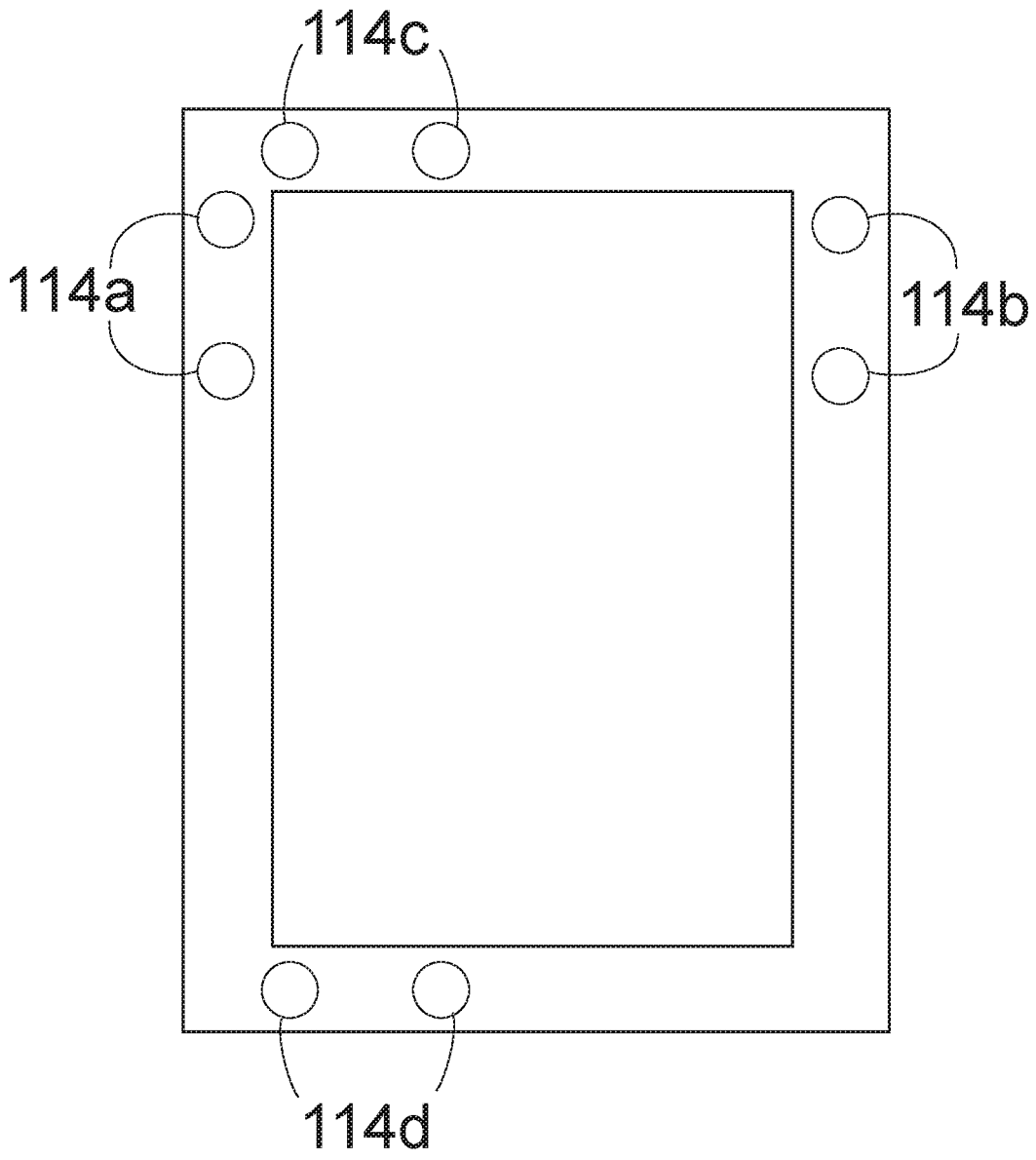

Ideally, the magnets are positioned on the frame enabling a user the optimal position to attach the legs. For instance, in the exemplary embodiment shown, the legs may be positioned on the magnets, such that the reusable writing surface stands in a vertical orientation. However, the user has the option to attach the legs such that the board may stand in a horizontal orientation. Best seen in FIG. 4, in the preferred embodiment, the plurality of magnets 114 includes a first pair of magnets 114*a* directly opposite a second pair of magnets 114*b* approximate to a first end 102*a* of board 102. Similarly, the plurality of magnets 114 includes a third pair of magnets 114*c* directly opposite a fourth pair of magnets 114*d* approximate to a first side 102*b* of board 102. This configuration enables the user to only place the legs in specific locations, such as vertical and horizontal configurations. For instance, magnetic legs 108 and 110 may be positioned in a magnetic connection with the first pair of magnets 114*a* and the second pair of magnets 114*b* for a vertical configuration. Similarly, magnetic legs 108 and 110 may be positioned in a magnetic connection with the third pair of magnets 114*c* and the fourth pair of magnets 114*d* for a horizontal configuration.

However, in other embodiments, the entire frame may be magnetic. Thus, indicia may be provided instructing the user where to attach the legs. Further, there may be several different leg designs, modifying the surface area on the frame, angle of the board in standing positions, etc. In some embodiments, the leg designs may vary for ornamental purposes, however the function of the magnet legs shall remain as discussed.

Figure 3:
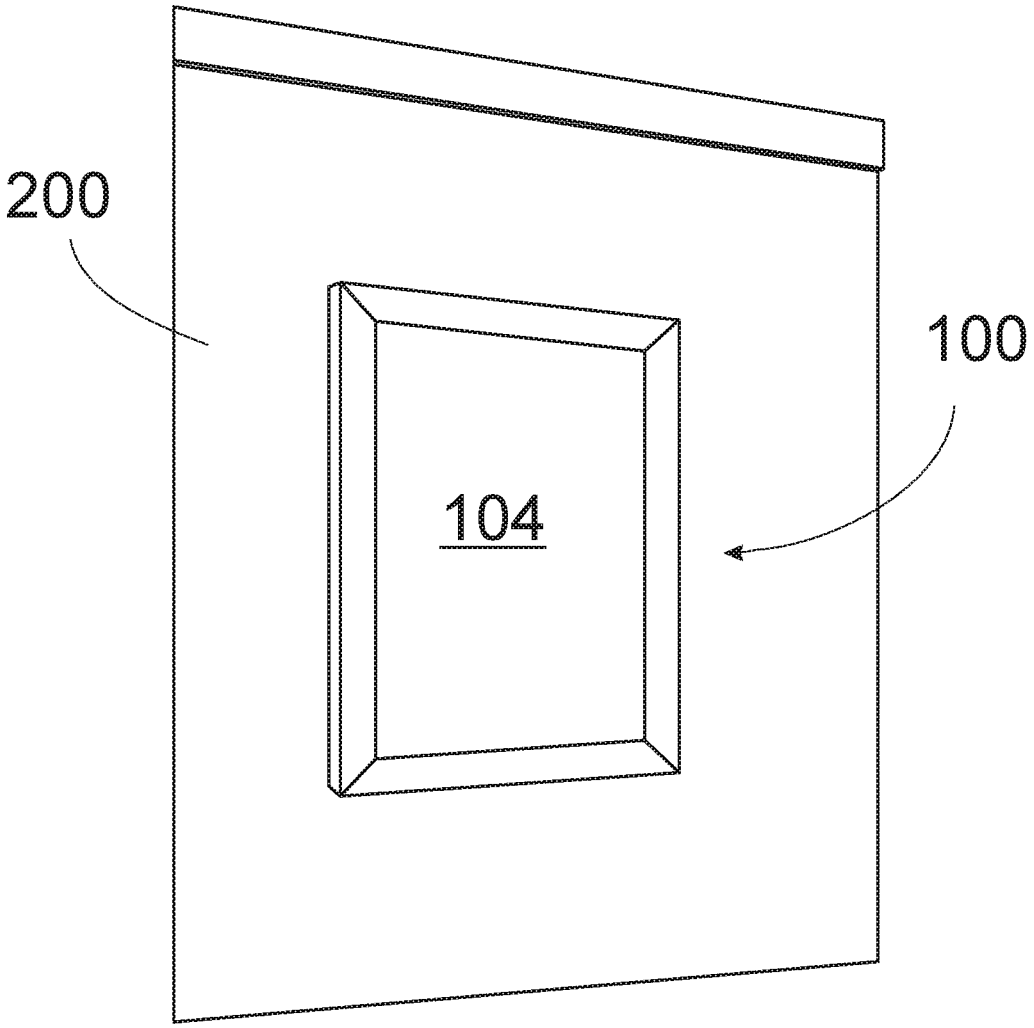
FIG. 3 is a right, front perspective view of the reusable writing surface with magnetic legs according to an embodiment of the present invention; and, FIG. 4 is a rear view showing the back side of the reusable writing surface with the plurality of magnets according to an embodiment of the present invention.

Referring now to FIG. 3, the present invention is shown positioned on a magnetic surface 200. In this embodiment, the magnetic legs are removed, and the board is magnetically attached to the magnetic surface via the plurality of magnets 114 (best seen in FIG. 2). Thus, the board is available for a user in a variety of convenient locations, such as any surface that attracts magnets, including but not limited to, refrigerators, dishwashers, office filing cabinets, metal shelving, etc. Advantageously, the reusable surface can be easily attached to the magnetic surface quickly, in any orientation, without the need to use traditional methods, such as the keyhole hanger. Further, the board can be quickly removed, and utilized in a free-standing position by attaching the magnetic legs in either a horizontal or vertical orientation.

Although, in the preferred embodiment, the board 102 is rectangular in shape, it should be understood the board may be any shape including, but not limited to, square, circular, triangular, star, oval, etc. In alternative embodiments, when the shape of the board is not rectangular, the plurality of magnets 114 configuration and positioning may vary depending on what the specific shape is and the different layouts possible with the shape selected.

In some embodiments, the present invention further comprises at least one member of an identification set consisting of: an alphanumeric identification, symbolic shape, a company brand, a numeric identification number, a QR code, a barcode, and an RFID tag. The identification set may be used to identify and/or provide information to the user, such as instructions for use.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention. For example, in some embodiments, the board may be reversible, and a reusable writing surface may be provided on both sides of the board.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A reusable writing surface comprising:

a board having a front side and a rear side, wherein the front side is a chalkboard or a whiteboard;

a frame;

a plurality of magnets positioned on the frame, wherein the plurality of magnets is configured to magnetically attach to a plurality of removable magnetic legs; and, the plurality of magnets is positioned such that the plurality of removable magnetic legs is configured to stand the reusable writing surface in either a vertical orientation or a horizontal orientation.

2. The reusable writing surface of claim 1, wherein the plurality of magnets include a first pair of magnets, a second pair of magnets, a third pair of magnets, and a fourth pair of magnets.

3. The reusable writing surface of claim 2, wherein the first pair of magnets is directly opposite the second pair of magnets approximate to a first end of the board.

4. The reusable writing surface of claim 3, wherein the third pair of magnets is directly opposite the fourth pair of magnets approximate to a first side of the board.

5. The reusable writing surface of claim 4, wherein the vertical orientation is comprised of the plurality of removable magnetic legs attached to the first and the second pair of magnets.

6. The reusable writing surface of claim 4, wherein the horizontal orientation is comprised of the plurality of removable magnetic legs attached to the third and the fourth pair of magnets.

7. The reusable writing surface of claim 1, wherein the board is rectangular shaped.

* * * * *